US006590443B1

(12) United States Patent
Vu

(10) Patent No.: US 6,590,443 B1
(45) Date of Patent: Jul. 8, 2003

(54) DYNAMIC BIASING FOR CASCODED TRANSISTORS TO DOUBLE OPERATING SUPPLY VOLTAGE

(75) Inventor: Luan M. Vu, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/144,946

(22) Filed: May 13, 2002

(51) Int. Cl.[7] ..... G05F 3/02
(52) U.S. Cl. ..... 327/540; 327/319
(58) Field of Search ..... 327/309, 318, 327/319, 333, 534, 535, 538, 540, 541, 543

(56) References Cited

U.S. PATENT DOCUMENTS 5,465,054 A * 11/1995 Erhart ..... 326/34
5,604,449 A 2/1997 Erhart et al. ..... 326/81
6,031,395 A * 2/2000 Choi et al. ..... 326/83
6,124,753 A 9/2000 Pease ..... 327/538

* cited by examiner

*Primary Examiner*—Jeffrey Zweizig
(74) *Attorney, Agent, or Firm*—Merchant & Gould P.C.; Mark R. Hennings

(57) ABSTRACT

Cascoded transistors can be used to allow circuits to operate at higher operating voltages than the voltages at which individual transistors (formed by a given process) can function. However, common techniques for cascading transistors result in circuits being unable to operate at lower operating voltages. The present invention dynamically biases cascoded transistors in response to the level of the operating voltage, which can vary. Providing separate dynamic bias voltages for N-type and P-type CMOS devices allows circuits using this technique to achieve a wider operating voltage. The wider operating range makes circuits using this technique readily adaptable to a range of power supplies (e.g., different battery configurations) and applications (e.g., driving displays).

20 Claims, 3 Drawing Sheets

DYNAMIC BIASING FOR CASCODED TRANSISTORS TO DOUBLE OPERATING SUPPLY VOLTAGE

FIELD OF THE INVENTION

The present invention relates generally to integrated CMOS circuits, and more particularly to a form of such circuits that permits the use of wider operating range power supplies for powering the circuits.

BACKGROUND OF THE INVENTION

CMOS is the most widely used technology for producing integrated circuits today. Processing techniques have been developed for producing highly dense CMOS integrated circuits. The CMOS integrated circuits have an operating voltage that is the magnitude of the difference between a first and second power supply voltage. The voltages that can be used to power CMOS circuits are dependent upon the physical dimensions of individual devices and the particular processes used. Accordingly, the voltages that are applied to a CMOS device should be limited to below certain voltages that the CMOS device can tolerate. In particular, a voltage applied across the source and drain terminals should not exceed a voltage (VDS) at which a channel breakdown will occur. Likewise, a voltage applied across the gate of a CMOS device should not exceed a voltage (VGS) at which a breakdown of the gate oxide dielectric will occur.

SUMMARY OF THE INVENTION

The present invention is directed towards an apparatus and method for allowing circuits to operate over a wider operating voltage range for a given process. Cascoded transistors can be used to allow circuits to operate at higher operating voltages than the voltages at which individual transistors (formed by a given process) can function. However, common techniques for cascoding transistors result in circuits being unable to operate at lower operating voltages. The present invention dynamically biases cascoded transistors in response to the level of the operating voltage, which can vary. Providing separate dynamic bias voltages for N-type and P-type CMOS devices allows circuits using this technique to achieve a wider operating voltage. The wider operating range makes circuits using this technique readily adaptable to a range of power supplies (e.g., different battery configurations) and applications (e.g., driving displays).

According to one aspect of the invention, a dynamic biasing comprises a comparator, a first biasing circuit, and a second biasing circuit. The comparator is configured to provide a comparison signal that is in a first state when the operating voltage is greater than the trip point voltage (Vtrip) and that is in a second state when the operating voltage is less than the trip point voltage. The trip point voltage is approximately set to be 500 mV less than the maximum operating voltage the process allows. The first biasing circuit provides the bias voltage for all the cascoded NMOS transistors. The first bias voltage is proportional to the operating voltage when the comparison signal is in the first state when the operating voltage is less than the trip point, and the bias voltage is fixed at the trip point voltage Vtrip when the comparison signal is in the second state when the operating voltage is higher than the trip point. The second biasing circuit provides the bias voltage for all the cascoded PMOS transistors. The second bias voltage is at a fixed voltage reference such as ground ("ground") when the comparison signal is in the first state, VDDA<Vtrip, and is proportional to the magnitude of the difference between the operating voltage and the trip point voltage when the comparison signal is in the second state, VDDA<Vtrip

DETAILED DESCRIPTION OF THE PREFERRED EMBODIMENT

Figure 1:
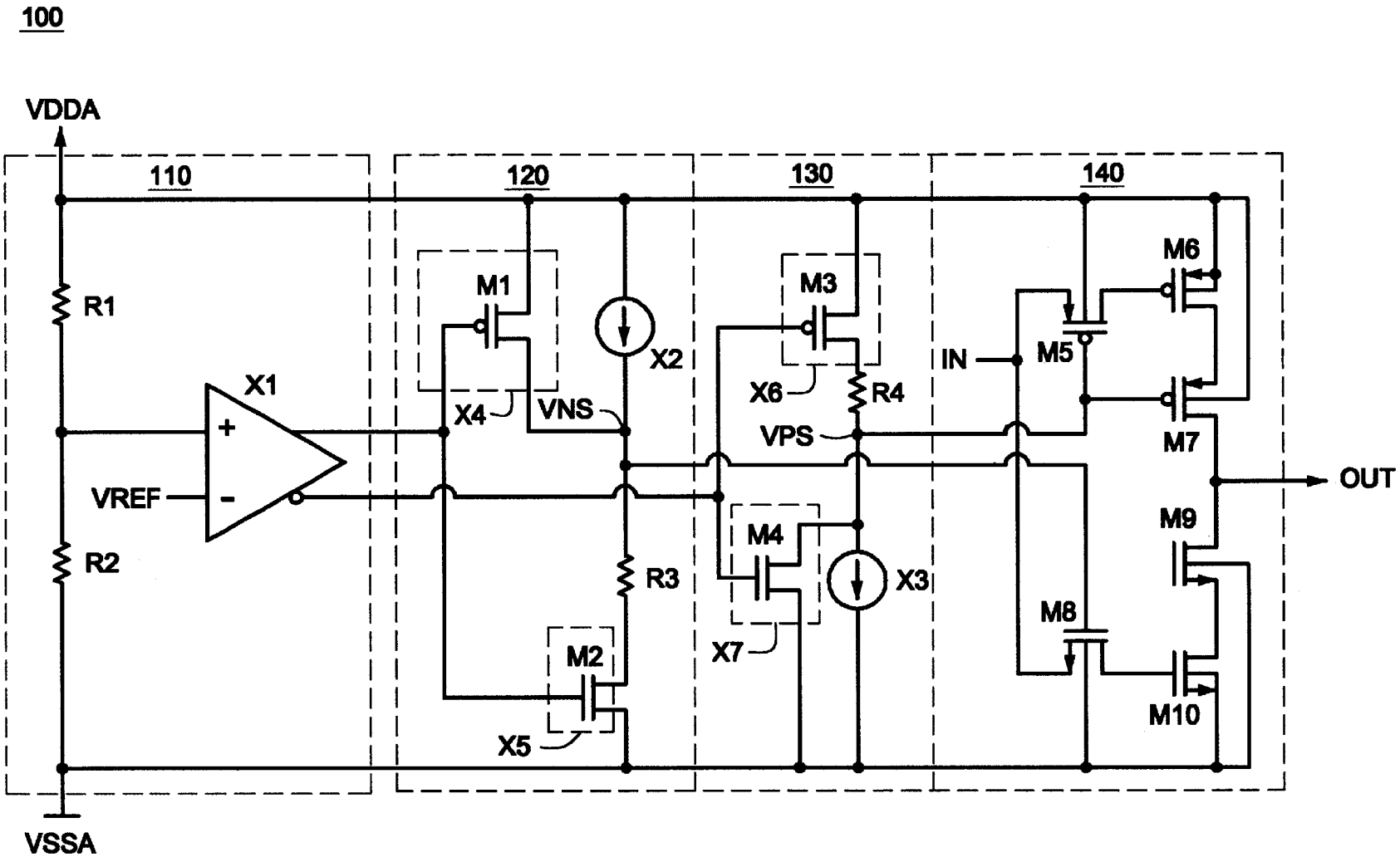
FIG. 1 shows a schematic of an example circuit for increasing the operating voltage range of a circuit by dynamically biasing cascoded transistors in accordance with the present invention.

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise. The meaning of "a," "an," and "the" includes plural reference. The meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, or data signal. Referring to the drawings, like numbers indicate like parts throughout the views.

The present invention is directed towards an apparatus and method for allowing circuits to operate over a wider operating voltage range for a given process. Cascoded transistors can be used to allow circuits to operate at higher operating voltages than the voltages at which individual transistors (formed by a given process) can function. However, common techniques for cascoding transistors result in circuits being unable to operate at lower operating voltages. As described below, the present invention dynamically biases a certain arrangement of cascoded transistors in response to the level of the operating voltage, which can vary. Providing separate dynamic bias voltages for N-type and P-type CMOS devices allows circuits using this technique to achieve a wider operating voltage. The wider operating range makes circuits using this technique readily adaptable to a range of power supplies (e.g., different battery configurations) and applications (e.g., display drivers).

CMOS circuits can be made to operate within a voltage range that is approximately twice the VDS or VGS breakdown voltage for a given process. Switches that may potentially have excessive VGS voltages can be protected by providing a blocking switch of the same type as the switch being protected. Switches that may potentially have excessive VDS voltages can be protected by using a cascode switch that has a source that is coupled to the drain of the switch being protected. Also, the cascode switch is the same type as the switch being protected. Separate dynamic bias currents are provided for each switch type such that no switch is exposed to a voltage that is greater than the VDS or VGS breakdown voltage for switches of a given process.

FIG. 1 shows a schematic of an example circuit for increasing the operating voltage range of a circuit by dynamically biasing cascoded transistors in accordance with the present invention. As shown in the figure, dynamically biasing circuit 100 includes operating voltage comparator 110, dynamic biasing circuit 120, dynamic biasing circuit 130, and exemplary circuit 140. The circuit has an operating voltage equal to the magnitude of the difference between power supply VDDA and power supply VSSA. In an example embodiment, a 5.5-volt CMOS process is used for the circuit, with the circuit having an operating voltage that ranges from 2–10 volts.

In an example embodiment, operating voltage comparator 110 comprises resistor R1, resistor R2, and comparator X1. Power supply VDDA is coupled to a first terminal of resistor R1. A second terminal of resistor R1 is coupled to a noninverting input of comparator X1 and a first terminal of resistor R2. Voltage reference VREF is coupled to an inverting input of comparator X1. Power supply VSSA is coupled to a second terminal of resistor R2.

Resistor R1 and resistor R2 are arranged as a voltage divider for scaling the operating voltage of the circuit. The voltage divider scales the operating voltage to a convenient level for comparison against voltage reference VREF. Voltage reference VREF may be provided by a voltage bandgap reference or any other suitable stable voltage reference. VREF=Vtrip*R2/(R1+R2). For a 5.5V process, Vtrip may be selected to be about 5V to allow some margin for process, temperature, and comparator offset variations.

The comparator is configured to provide a comparison signal that is in a first state when the operating voltage is greater than the trip point voltage and that is in a second state when the operating voltage is less than the trip point voltage.

In an example embodiment, dynamic biasing circuit 120 comprises switch MI (PMOS), switch M2 (NMOS), current source X2, and resistor R3. Power supply VDDA is coupled to a first switched terminal of switch M1 and a first terminal of current source X2. A second switched terminal of switch M1 is coupled to node VNS. A second terminal of current source X2 is coupled to node VNS. The control terminals of switches M1 and M2 are coupled to a noninverting output of comparator X1. Resistor R3 has a first terminal that is coupled to node VNS and a second terminal that is coupled to a first switched terminal of switch M2. Switch M2 has a second switched terminal that is coupled to power supply VSSA. (For simplicity switch M1 is shown as being coupled to VDDA: in operation, switch M1 should be protected against excessive VGS voltages.)

Dynamic biasing circuit 120 is configured to provide a first dynamic bias voltage (at node VNS) in response to the level of the operating voltage and the comparison signal. The VNS node provides bias voltage for all cascoded NMOS transistors. When the comparison signal is in the first state (i.e., when the operating voltage is less than Vtrip), switch M1 is turned on and switch M2 is turned off. The conductive path through switch M1 maintains node VNS at a voltage that is proportional (including being equal) to the operating voltage. When the comparison signal is in the second state (i.e., when the operating voltage is greater than Vtrip), switch M1 is turned off and switch M2 is turned on. Current source X2, resistor R3, and the conductive path through switch M2 cooperate to maintain the second dynamic bias voltage VNS at a fixed level that is proportional to Vtrip, as described in Equation 1 below:

$$V_{VNS}=I_{X2}\times R3, \text{ where} \tag{1}$$

$I_{X2}$=VBG/RREF, $V_{VNS}=I_{X2}\times R3=VBG\times(R3/RREF)=Vtrip$ (1), and where $V_{VNS}$ is simply described as being in direct proportion to the bandgap voltage.

The current source (X2) is preferably generated by applying a bandgap voltage across a reference resistor RREF of the same type of R3 such that process and temperature variation effects on R3 are canceled out by RREF.

In an example embodiment, dynamic biasing circuit 130 comprises switch M3 (PMOS), switch M4 (NMOS), current source X3, and resistor R4. Power supply VDDA is coupled to a first switched terminal of switch M3. A second switched terminal of switch M3 is coupled to a first terminal of resistor R4. A second terminal of resistor R4 is coupled to node VPS. The control terminals of switches M3 and M4 are coupled to an inverting output of comparator X1. A first switched terminal of switch M4 is coupled to node VPS. A first terminal of current source X3 is coupled to node VPS. Power supply VSSA is coupled to a second switched terminal of switch M4 and a second terminal of current source X3. (For simplicity switch M3 is shown as being coupled to VDDA: in operation, switch M3 should be protected against excessive VGS voltages.)

Dynamic biasing circuit 130 is configured to provide a second dynamic bias voltage (at node VPS) in response to the level of the operating voltage and the comparison signal. This VPS node provides bias voltage for all cascoded PMOS transistors. When the comparison signal is in the first state (i.e., when the operating voltage is less than Vtrip), switch M3 is turned off and switch M4 is turned on. The conductive path through switch M4 maintains node VPS at a voltage that is proportional (including being equal) to power supply VSSA. When the comparison signal is in the second state (i.e., when the operating voltage is greater than Vtrip), switch M3 is turned on and switch M4 is turned off. Current source X3, resistor R4, and the conductive path through switch M3 cooperate to produce a voltage (VPS) that is proportional (including being equal) to the magnitude of the difference between the operating voltage VDDA and Vtrip:

$$\begin{aligned} VPS &= VDDA - IX3\times R4, \text{ and} \\ &= VDDA - VBG\times(R4/RREF), \text{ such that} \\ &= VDDA - Vtrip\,(2). \end{aligned} \tag{2}$$

In an example embodiment, exemplary circuit 140 comprises switches M5–M10, which are configured as an expanded range logic inverter. Although an inverter is given herein as an example, the invention is suitable for use in other circuits. The invention may be implemented in more (or less) complex logic circuits, as well as in analog circuits such as comparators and differential amplifiers. An example of the invention embodied in an analog circuit is given below with reference to FIG. 3.

Power supply VDDA is coupled to a substrate of switch M5 (PMOS), a source and substrate of switch M6 (PMOS) and a substrate of switch M7 (PMOS). A source of switch M5 is coupled to node IN. A drain of switch M5 is coupled to a gate of switch M6. A gate of switch MS is coupled to node VPS. A drain of switch M6 is coupled to a source of switch M7. A gate of switch M7 is coupled to node VPS. A drain of switch M7 is coupled to node OUT. A drain of switch M9 (NMOS) is coupled to node OUT. Power supply VSSA is coupled to a substrate of switch M8 (NMOS), a source and substrate of switch M10 (NMOS), and a substrate of switch M9. A gate of switch M9 is coupled to node VNS. A source of switch M9 is coupled to a drain of switch M10. A gate of switch M8 is coupled to node VNS. A source of switch M8 is coupled to node IN. A drain of switch M8 is coupled to a gate of switch M10.

Switches M5 and M7 are arranged to protect switch M6 from voltages exceeding breakdown limits for the process used to form the switches. Switch M5 addresses the potential VGS breakdown of switch M6. An excessive VGS could potentially exceed the VGS breakdown voltage and/or affect the reliability of switch M6. This potentiality exists for switch M6 because the source and substrate of switch M6 are tied to node VDDA, which is the operating voltage. When the operating voltage is greater than Vtrip (which is set at 5V), the bias voltage VPS (which is equal to VDDA−Vtrip) prevents the gate of switch M6 from dropping below a threshold voltage (Vtp) below VPS. The gate voltage is maintained because when the gate voltage of switch M5 is less than or equal to the voltage difference between VPS and Vtp, switch M5 is turned off. When switch M5 is turned off, there is no available current path through which the charge on the gate of M6 can discharge. Accordingly, the VGS of switch M6 is given by:

$$\begin{aligned} VGS(M6) &= VDDA - VG(M6), \quad \text{such that} \\ &= VDDA - (VDDA - Vtrip - Vtp), \quad \text{such that} \\ &= Vtrip + Vtp. \end{aligned}$$

For example, the VGS of switch M6 is 4.2V when Vtrip equals 5V and Vtp equals 0.8V. Thus, switch M6 is protected against a potentially damaging VGS breakdown voltage.

Switch M7 addresses the potential VDS breakdown of switch M6. An excessive VDS could potentially exceed the VDS breakdown voltage and/or affect the reliability of switch M6. This potentiality exists for switch M6 because the source and substrate of switch M6 are tied to node VDDA, which is the operating voltage. When the operating voltage is greater than Vtrip, and node OUT is at VSSA (e.g. 0 volts), the drain voltage of switch M6 is given by:

VD(M6)=VPS−Vtp(M6)−Vod(M6), where

Vtp(M6) is the threshold voltage of switch M6, and

Vtp(M6) is the overdrive voltage of switch M6.

The drain-to-source voltage of switch M6 is given by:

$$\begin{aligned} VDS(M6) &= VDDA - VD(M6), \quad \text{such that} \\ &= VDDA - (VDDA - Vtrip - Vtp - Vod), \quad \text{such that} \\ &= Vtrip + Vtp + Vod. \end{aligned}$$

For example, the VDS of switch M6 is 3.8V when Vtrip equals 5V, Vtp equals 0.8V, and Vod equals 3.8V. Thus, the cascoding of the switches protects switch M5 against a potentially damaging VDS breakdown voltage.

Switch M10 is similarly protected against a VGS breakdown by switch M8 and is similarly protected against a VDS breakdown by switch M9.

This invention accordingly allows circuit 140 to operate at operating voltages that are lower than prior art solutions. Where VDDA<Vtrip, Vin=0V, and M6 is on and VPS=0V:

$$\begin{aligned} VDDA &= VDDA - VPS, \\ &= VSG(M5) + VSG(M6), \\ &= -(Vtp(M5) + Vtp(M6) + Vod(M6)), \quad \text{such that} \\ VDDA &= -2Vtp - Vod. \end{aligned}$$

Accordingly, the minimum operating voltage is:

$$\begin{aligned} VDDAmin &= 2 \times 0.8\ \text{V} + 0.4\ \text{V}, \\ &= 2.0\ \text{V}. \end{aligned}$$

The minimum operating voltage is half of the operating voltage is required when VS is used to bias cascoded switches M5, M7, M8, and M9, where VS=VDDA/2. The lower operating voltage advantageously provides lower power dissipation, which can provide longer battery life.

In operation, the PMOS switches (M5 and M7) are turned off (by dynamic bias current VPS) for protection against voltage breakdowns when the operating voltage rises above Vtrip. Also, the NMOS switches (M8 and M10) are turned off by dynamic bias current VNS when the operating voltage rises above voltage Vtrip. When the operating voltage falls below voltage Vtrip, cascoding is not required, VNS and VPS are biased at the most positive voltage (VDDA) and most negative voltage (VSSA) to allow for maximum headroom.

Figure 2:
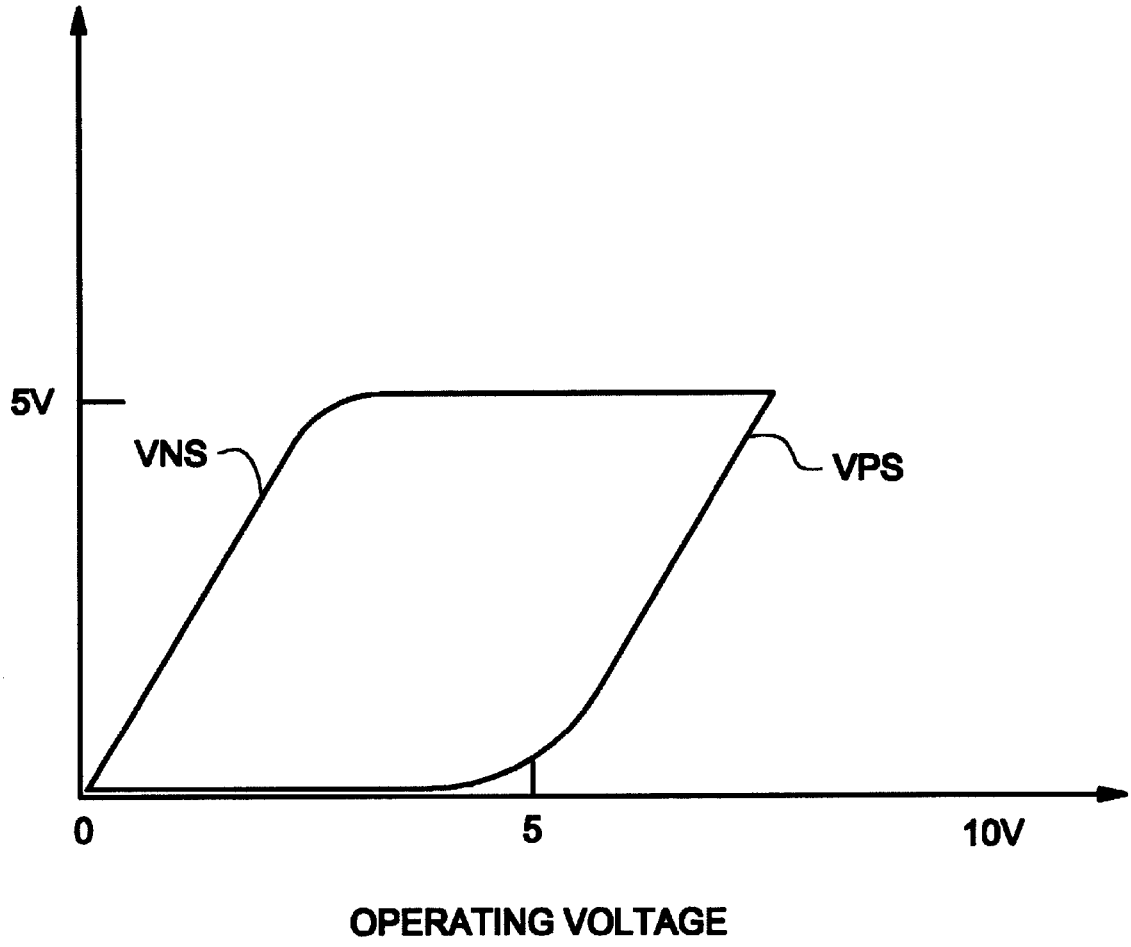
FIG. 2 shows a graph of dynamic bias voltage VNS and dynamic bias voltage VPS as a function of an example circuit operating voltage in accordance with the present invention.

FIG. 2 shows a graph of dynamic bias voltage VNS and dynamic bias voltage VPS as a function of the circuit operating voltage in accordance with the present invention. The graph demonstrates the response of the bias voltages in a circuit. The example circuit has a maximum operating voltage of 10 volts and a voltage reference VREF of 1.23 volts. The horizontal axis represents the possible range of the operating voltage. The vertical axis represents the response of the dynamic bias voltages to the level of the operating voltage.

As illustrated in the graph, dynamic bias voltage VNS is approximately equal to the operating voltage when the operating voltage is in the range of zero through five volts. When the operating voltage is greater than five volts, dynamic bias voltage VNS maintains a level of five volts. Dynamic bias voltage VPS maintains a level of zero volts (ground) when the operating voltage is in the range of zero through five volts. When the operating voltage is greater than five volts, dynamic bias voltage VPS is approximately equal to the level of the operating voltage minus five volts.

Figure 3:
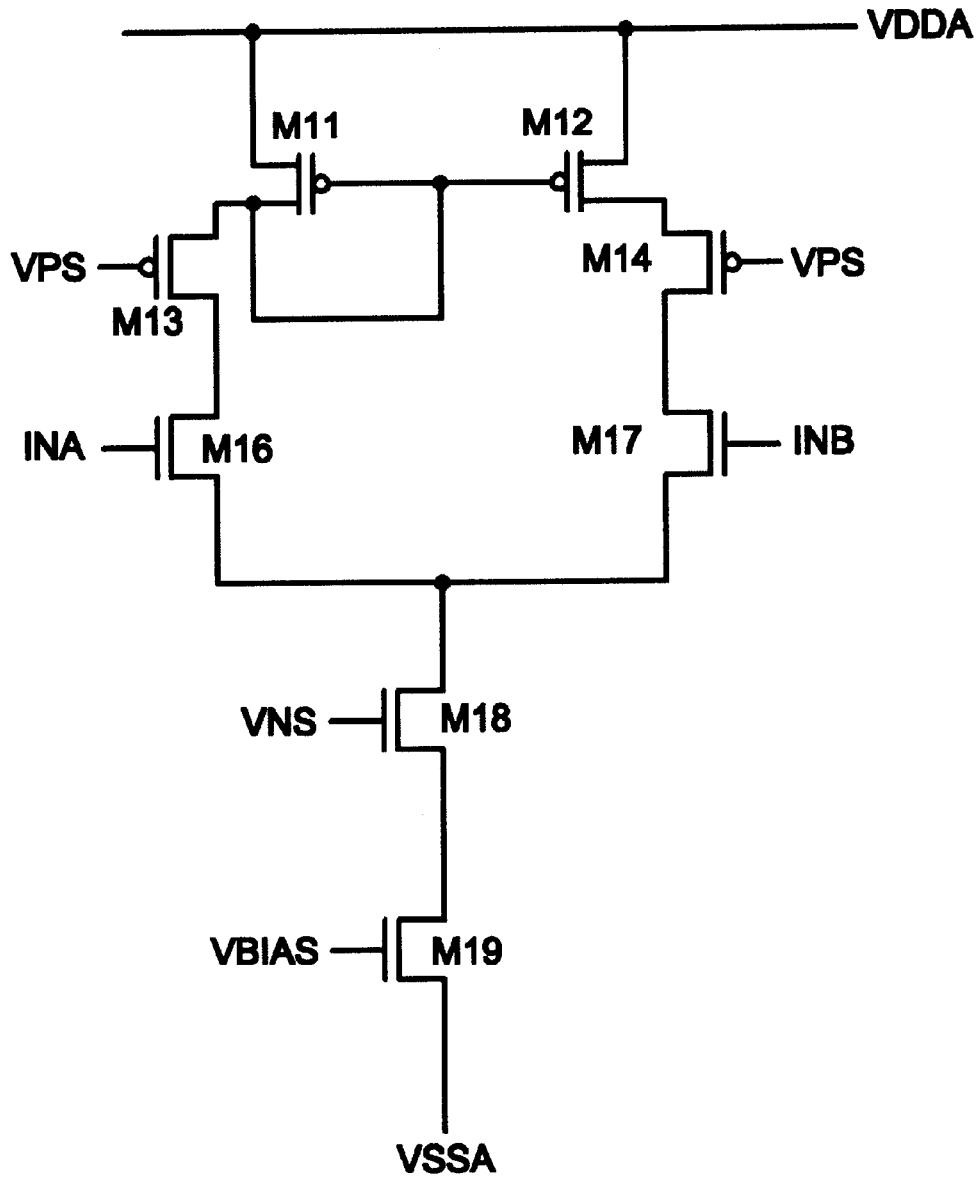
FIG. 3 shows a schematic diagram of an example analog circuit having an increased operating voltage range in accordance with the present invention.

FIG. 3 shows a schematic diagram of an example analog differential amplifier circuit having an increased operating voltage range in accordance with the present invention. Exemplary analog circuit 300 can operate within a voltage range that is approximately twice the VDS or VGS breakdown voltage for a given process. Switches (e.g., M11 and M12) are protected against potentially excessive VGS/VDS voltages by providing cascoded switches (e.g., M13 and M14) of the same type as the switches being protected. Cascoding switch M18 protects switch M19 against excessive VDS voltages. Separate dynamic bias currents (e.g., VNS and VPS) are provided for each switch type such that no switch is exposed to a voltage that is greater than the VDS or VGS breakdown voltage for switches of a given process. Dynamic bias voltage VPS is provided for P-type switches, while dynamic bias voltage VNS is provided for N-type switches. The operation of dynamic bias voltages VNS and VPS is similar to the above description with reference to the above figures.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A dynamic biasing circuit for providing a wider operating range, the circuit comprising:

a comparator that is configured to provide a comparison signal that is in a first state when the operating voltage is greater than the trip point voltage and that is in a second state when the operating voltage is less than the trip point voltage;

a first biasing circuit having a first biasing output that is configured to provide a first bias voltage at the first biasing output in response to the comparison signal and the operating voltage, wherein the first bias voltage is proportional to the operating voltage when the comparison signal is in the first state and is proportional to the trip point voltage when the comparison signal is in the second state; and a second biasing circuit having a second biasing output that is configured to provide a second bias voltage at the second biasing output in response to the comparison signal and the operating voltage, wherein the second bias voltage is proportional to a ground of the operating voltage when the comparison signal is in the first state and is proportional to the magnitude of the difference between the operating voltage and the trip point voltage when the comparison signal is in the second state.

2. The circuit of claim 1, further comprising a CMOS circuit that comprises:

N-type devices that are coupled to the first biasing output; and

P-type devices that are coupled to the second biasing output.

3. The circuit of claim 2, wherein CMOS circuit is a logic inverter.

4. The circuit of claim 2, wherein the CMOS circuit is a differential amplifier.

5. The circuit of claim 1, further comprising:

a first N-type device having a gate that is coupled to the first biasing output; and a second N-type device having a gate that is coupled to a drain of the first N-type device.

6. The circuit of claim 5, further comprising: a third N-type device having a gate that is coupled to the first biasing output and a source that is coupled to a drain of the second N-type device.

7. The circuit of claim 6, further comprising:

a first P-type device having a gate that is coupled to the second biasing output; and a second P-type device having a gate that is coupled to a drain of the first P-type device.

8. The circuit of claim 7, further comprising: a third P-type device having a gate that is coupled to the second biasing output and a source that is coupled to a drain of the second P-type device.

9. A circuit for dynamically biasing switches within a circuit having a variable operating voltage that is defined by the difference between a first voltage of a first power supply and a second voltage of a second power supply, comprising:

means for comparing an operating voltage with a trip point voltage such that a comparison signal has a first state when the operating voltage is less than the trip point voltage and a second operating state when the operating voltage is greater than the trip point voltage;

means for providing a first bias signal in response to the comparison signal;

means for causing the first bias signal to bias a first switch of a first type;

means for providing a second bias signal in response to the comparison signal, wherein the second bias signal is different from the first bias signal; and means for causing the second bias signal to bias a second switch of a second type that is opposite the first type.

10. The circuit of claim 9, further comprising means for selecting the level of the trip point voltage to be between 85 percent and 95 percent of the maximum operating voltage the CMOS process that is used to implement the circuit allows.

11. The circuit of claim 9, further comprising:

means for coupling a drain of the first switch to a gate of a third switch, wherein the third switch has a type that is equal to the first type; and means for coupling a drain of the second switch to a gate of a fourth switch, wherein the fourth switch has a type that is equal to the second type.

12. The circuit of claim 9, further comprising:

means for setting the first bias signal to a voltage level that is proportional to the operating voltage when the comparison signal is in the first state and setting the first bias signal to a voltage level that is proportional to the trip point voltage level when the comparison signal is in the second state.

13. The circuit of claim 9, further comprising:

means for setting the second bias signal to a voltage level that is proportional to the second power supply when the comparison signal is in the first state and setting the second bias signal to a level that is proportional to the magnitude of the difference between the operating voltage and the trip point voltage level when the comparison signal is in the second state.

14. The circuit of claim 9, further comprising:

means for setting the first bias signal to a voltage level that is proportional to the operating voltage when the comparison signal is in the first state and setting the first bias signal to a voltage level that is proportional to the trip point voltage level when the comparison signal is in the second state; and means for setting the second bias signal to a voltage level that is proportional to the second power supply when the comparison signal is in the first state and setting the second bias signal to a level that is proportional to the magnitude of the difference between the operating voltage and the trip point voltage level when the comparison signal is in the second state.

15. A method for dynamically biasing switches within a circuit having an operating voltage that is defined by the difference between a first voltage of a first power supply and a second voltage of a second power supply, comprising:

comparing an operating voltage with a trip point voltage such that a comparison signal has a first state when the operating voltage is less than the trip point voltage and a second operating state when the operating voltage is greater than the trip point voltage;

providing a first bias signal in response to the comparison signal;

using the first bias signal to bias a first switch of a first type;

providing a second bias signal in response to the comparison signal, wherein the second bias signal is different from the first bias signal; and using the second bias signal to bias a second switch of a second type that is opposite the first type.

16. The method of claim 15, further comprising selecting the level of the trip point voltage to be between 85 percent and 95 percent of the maximum operating voltage the CMOS process that is used to implement the circuit allows.

17. The method of claim 15, further comprising:

coupling a drain of the first switch to a gate of a third switch, wherein the third switch has a type that is equal to the first type; and coupling a drain of the second switch to a gate of a fourth switch, wherein the fourth switch has a type that is equal to the second type.

18. The method of claim 15, further comprising:

setting the first bias signal to a voltage level that is proportional to the operating voltage when the comparison signal is in the first state and setting the first bias signal to a voltage level that is proportional to the trip point voltage level when the comparison signal is in the second state.

19. The method of claim 15, further comprising:

setting the second bias signal to a voltage level that is proportional to the second power supply when the comparison signal is in the first state and setting the second bias signal to a level that is proportional to the magnitude of the difference between the operating voltage and the trip point voltage level when the comparison signal is in the second state.

20. The method of claim 15, further comprising:

setting the first bias signal to a voltage level that is proportional to the operating voltage when the comparison signal is in the first state and setting the first bias signal to a voltage level that is proportional to the trip point voltage level when the comparison signal is in the second state; and setting the second bias signal to a voltage level that is proportional to the second power supply when the comparison signal is in the first state and setting the second bias signal to a level that is proportional to the magnitude of the difference between the operating voltage and the trip point voltage level when the comparison signal is in the second state.

* * * * *